United States Patent [19]

King et al.

[11] 4,020,775

[45] May 3, 1977

[54] TOE CLOSING MACHINE AND METHOD FOR PANTY HOSE

[75] Inventors: J. Frank King; Willie M. Lathery; Howard L. Beamon, all of Winston-Salem, N.C.

[73] Assignee: Hanes Corporation, Winston-Salem, N.C.

[22] Filed: July 21, 1975

[21] Appl. No.: 597,325

[52] U.S. Cl. ..... 112/121.15; 112/252; 112/DIG. 2; 112/262

[51] Int. Cl.[2] ..... D05B 21/00

[58] Field of Search ..... 112/121.15, 121.11, 112/121.12, 252, DIG. 2, DIG. 3, 121.29, 262

[56] References Cited

UNITED STATES PATENTS

| | | | |
|---|---|---|---|
| 3,099,970 | 8/1963 | Hite | 112/DIG. 2 |
| 3,149,594 | 9/1964 | Buckreus et al. | 112/252 |
| 3,217,680 | 11/1965 | Harris, Jr. et al. | 112/252 |
| 3,738,294 | 6/1973 | Christiansen | 112/121.15 |
| 3,875,880 | 4/1975 | Hazelgrove et al. | 112/121.15 |
| 3,952,673 | 4/1976 | Fukuyama | 112/121.15 |

FOREIGN PATENTS OR APPLICATIONS

| | | | |
|---|---|---|---|
| 2,131,186 | 10/1972 | France | 112/121.15 |

*Primary Examiner*—Werner H. Schroeder

*Assistant Examiner*—Peter Nerbun

*Attorney, Agent, or Firm*—Robert B. Frailey

[57] ABSTRACT

Automated machine and method for closing the toe ends of an otherwise completed panty hose type garment, by seams which are inside the toes when the finished garment is right side out. The machine consists basically of a garment input section, toe closing section and discharge section. The input section includes means for mounting the garment and then advancing the toe ends of its leg portions to the toe closing section, preparatory to closing the toes. The toe closing section includes a seaming device forming identical seams in the toe ends of the garment by a chain of stitches, an automatic trimmer for cutting the chain of stitches close to the toe fabrics and toe fabric clamping assemblies to deliver the toe ends to the seaming device. The discharge section includes means for receiving the garment, following the toe closing operation, and for the removal of the finished garment, right side out, from the machine in completed condition ready for packaging. The method of the invention is carried out in timed sequence at high speed to produce a finished panty hose type garment in which the toe ends of both legs have been closed by precisely controlled toe closing operations to produce identical toe closing results in the garment.

20 Claims, 17 Drawing Figures

TOE CLOSING MACHINE AND METHOD FOR PANTY HOSE

SUMMARY OF THE INVENTION

The primary object of this invention is to provide a new machine and method for closing the toes of an otherwise completed panty hose type garment, by seams which are inside the finished garment when it is right side out. The invention provides for the precise, controlled and identical closing of the toe ends of a panty hose garment, to provide a finished garment ready for packaging.

A further object is to provide a new machine and method for closing the toe ends of a bifurcated garment having waist, pant, leg and toe fabric portions, in which the garment first is turned inside out, following which the two toe ends are handled in exactly the same manner, in carefully controlled time and speed sequence, to produce identical toe closures in the garment. Following closing of the toes, the finished garment is inverted right side out.

A further object is to provide a new machine and method for closng the toes of a panty hose type garment, which provides automatically for the trimming of the toe closing stitch chain closely adjacent to both the leading and trailing edges of the toe fabrics.

A further object is to provide a new toe closing machine for panty hose and similar garments, which is provided with a novel magnetic, safety break-away feature, which immediately arrests the automated operation of the garment input section of the machine in the event a foreign obstacle, such as a human hand, is located in the path of movement of the advancing machine parts.

A further object is to provide a new and improved method for closing the toes of an otherwise completed panty hose type garment, in which the invention is carried out in timed sequence at high speed to produce identical, precisely controlled, toe closing seams in the garment, to provide a finished garment in completed condition ready for packaging.

To achieve the foregoing objectives, the invention, in its preferred form, provides a high speed automated machine composed basically of a garment input section, a toe closing section and a garment discharge section. In operation, the panty hose garment, completed except for the closing of its toes, is mounted on the input section inside out, and precisely positioned for the toe closing operation. The garment then is delivered automatically to the toe closing section, where the toes are rapidly closed by precisely controlled, identical seams, while being transferred to the garment discharge section substantially simultaneously with the toe closing operation. Following closing of the toes, the entire garment is received by the discharge section, from which it is removed automatically, right side out, in completed condition ready for packaging.

Other objects and advantages of this invention will be readily apparent from the following description of a preferred embodiment thereof, reference being had to the accompanying drawing.

DETAILED DESCRIPTION OF THE INVENTION

Figure 1:
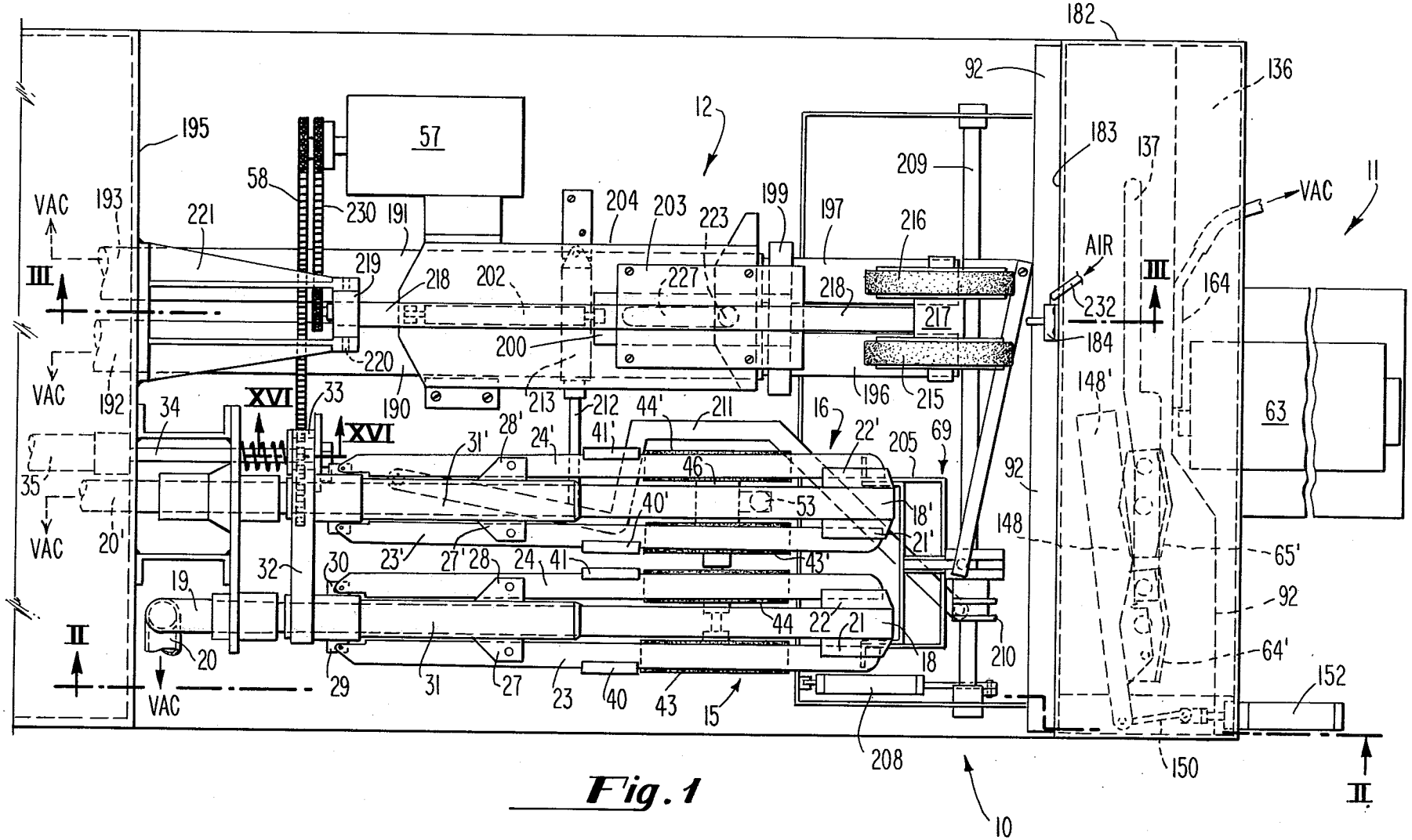
FIG. 1 is a fragmentary view in plan showing a preferred toe closing machine for panty hose embodying this invention.

This invention comprises improvements to hosiery toe closing apparatus of the type disclosed in Hazelgrove et al U.S. Pat. No. 3,875,880, whereby such apparatus is improved and modified to provide for the toe closing of panty-hose type garments. Referring to FIG. 1, the machine of this invention consists basically of a garment input section 10, a toe closing section 11 and a garment discharge section 12.

Garment Mounting

Figure 2:
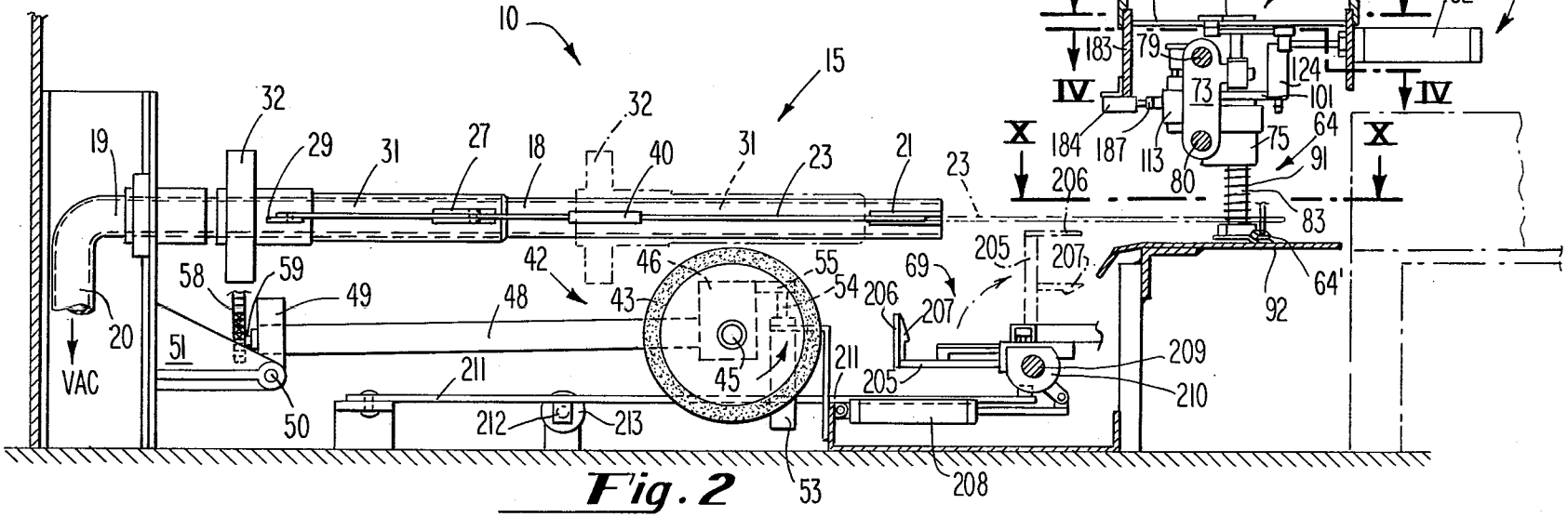
FIG. 2 is a sectional view in front elevation looking in the direction of the arrows II—II of FIG. 1, showing the garment input section of the machine.

As illustrated in FIGS. 1 and 2, the garment input section 10 includes a pair of horizontal, transversely spaced carrier leg assemblies 15, 16 similar to those illustrated in U.S. Pat. No. 3,875,880, aforesaid. The leg assembly 15 includes a stationary, longitudinally extending vacuum tube 18 connected at its rear end 19, through a suitable conduit 20, to a vacuum pump (not shown) or other conventional vacuum or suction source. The forward or distal end of the vacuum tube 18 mounts a pair of horizontal, transversely extending guides 21, 22 secured to opposite sides of the tube. The guides are provided with elongated, longitudinal extending slots for the slidable reception, respectively, of a pair of horizontal reciprocal blades 23, 24 disposed on opposite sides of the vacuum tube 18. The blades 23, 24 are secured by transverse brackets 27, 28 and 29, 30 to a reciprocal tube 31 mounted telescopically externally of the vacuum tube 18. The reciprocal tube 31 is affixed to a yoke 32 which is provided with a transverse extension 33 for connection to the distal end of a piston rod 34 of a pneumatic cylinder 35. Each blade 23, 24 is provided on its outer edge with a garment stop 40, 41, disposed intermediate the ends of the blades.

The second carrier leg assembly 16 is of identical construction, having a stationary longitudinal vacuum tube 18' connected by a suitable conduit 20' to a vacuum source (not shown), and a pair of transverse guides 21', 22' for the slidable reception of a pair of transversely spaced reciprocal blades 23', 24'. Brackets secure the blades 23', 24' to a reciprocal tube 31' affixed to the yoke 32.

The reciprocal tubes 31, 31' are slidable over the stationary vacuum tubes 18, 18' to advance the forward ends of the baldes 23, 24 and 23', 24' to the toe closing section 11, as illustrated by the shadow lines in FIG. 2, preparatory to the toe closing operation provided by the machine. The pneumatic cylinder 35 is controlled by a sequence programmer (not shown) for the machine, to advance and retract the piston rod 34, yoke 32 and slidable tubes 31, 31' to advance and retract the forward ends of the blades to and from the toe closing section 11.

Figure 16:
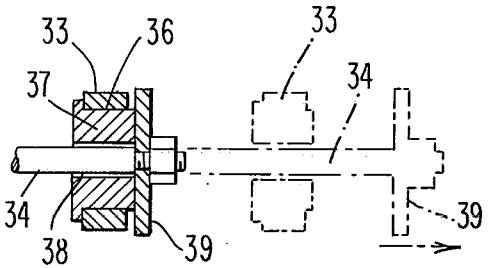
FIG. 16 is an enlarged, fragmentary view in section indicated by the arrows XVI—XVI of FIG. 1, showing the preferred magnetic breakaway safety mechanism of this invention.

As is illustrated in detail in FIG. 16, the extension 33 of the yoke 32 is provided with a transverse slot 36 for the reception of a permanent magnet 37. The magnet 37 has a bore 38 providing passage for the piston rod 34. Affixed to the distal end of rod 34 is a plate 39 of steel or other suitable metal readily attracted to the magnet. The force of the magnetic connection between the plate 39 and the magnet 37 is of sufficient strength to cause the longitudinal advance of yoke 32, slidable tubes 31, 31' and blades 23, 24, 23', 24' when the cylinder 35 is actuated to advance its piston rod 34. Should any foreign obstacle, such as the human hand, be placed in the path of movement of one of the blades 23, 24, 23', 24', the magnetic connection between magnet 37 and plate 39 will be broken. Those parts will separate, as indicated by the shadow lines in FIG. 16, and the forward advance of the blades, tubes and yoke will be arrested. Thus, the magnetic connection between the magnet 37 and the plate 39 provides a breakaway safety mechanism which, while sufficiently strong to advance the yoke, tubes and blades under normal operating conditions, will readily separate if a human hand or other obstacle is interposed in the path of advance of the blades.

Disposed below the leg assemblies 15, 16 is a vertically pivotable wind-on wheel assembly 42 (FIGS. 1, 2). The wind-on wheel assembly includes four axially aligned, transversely spaced, foam rimmed wheels 43, 44, 43', 44' disposed, respectively, vertically below the reciprocal blades 23, 24, 23', 24'. The four wind-on wheels 43, 44, 43', 44' are mounted for rotation, in the direction of the arrow shown in FIG. 2, on co-axial shafts 45 driven from a gear box 46. The outer casing of the gear box is mounted on the distal end of an elongated, hollow tube 48, the proximal end of which is secured within a collar 49 pivotal about a horizontal, transverse pivot 50 supported by a bracket 51 forming part of the machine frame. The wind-on wheel assembly 42 normally is retained with its wheels 43, 44, 43', 44' retracted below their respective blades 23, 24, 23', 24'. The wheel assembly is pivotal upwardly, to place the peripheries of its wind-on wheels in frictional engagement with the bottoms of the blades, by means of a pneumatic cylinder 53, the external piston rod 54 of which is connected to the casing of the gear box by a lateral extension 55. The wind-on wheels 43, 44, 43', 44' are driven continuously by means of a motor 57 provided with a conventional sprocket wheel and chain drive 58. The latter is connected drivingly to a shaft 59 disposed internally of the hollow tube 48 and connected to the gearing in the gear box 46, by which rotational drive is imparted to the co-axial wheel shafts 45.

In operation, a panty hose garment, finished except for the closing of its toe portions, is mounted on the input section 10 of the machine as follows: The operator presents each of the toe ends of the garment to the open end of one of the vacuum tubes 18, 18'. The suction within the vacuum tubes draws the toe and leg portions of the garment into the tubes. The operator then pulls the waist opening of the garment inside out over the two leg assemblies 15, 16, aligns the garment on the two assemblies, and then actuates a stitch (not shown). The switch is operative to remove the vacuum from within the tubes 18, 18' while actuating the pneumatic cylinder 53 to advance the wind-on wheels 43, 44, 43', 44' into frictional contact with their respective blades, over which the panty portion of the garment has been mounted. The frictional drive of the wind-on wheels draws the garment from the tubes 18, 18' onto the leg assemblies 15, 16, inside out, with the toe ends disposed adjacent the open ends of the tubes.

The period of time during which the wind-on wheel assembly 42 is maintained in its raised position is determined by the setting of a conventional electric timer (not shown). After the garment has been fully mounted on the input section 10 of the machine, each of the leg assemblies 15, 16 is disposed within one of the legs of the garment. The operator then aligns the toe portion of the leg with respect to identification markings (not shown) provided on the distal end of each leg assembly. The garment now is prepared for the toe closing operation, which takes place in the toe closing section 11 of the machine.

The Toe Closing Section

The main elements of the toe closing section 11 are a seaming device 63 (FIGS. 1, 10, 11), which may be a conventional sewing machine; a pair of movable clamp assemblies 64, 65 having, respectively, transversely spaced toe fabric clamps 64', 65' (FIGS. 1, 2, 4–8), for clamping and delivering the toe portions T, T' of the garment G to the seaming device 63 to be closed (FIGS. 10, 11); a clamp drive assembly 66 (FIG. 4) for advancing the clamp assemblies past the seaming device, to close the clamped toe fabrics by suitable seams; a clamp guide cam assembly 67 (FIG. 9) to impart identical, precisely controlled movements to the toe clamps, to produce identical toe closing results in the garment; a stitch chain trimmer 68 (FIGS. 12–15) associated with the seaming device 63, to trim the stitch chain produced by the seaming device closely adjacent to the leading and trailing edges of the toe fabric; and a garment transfer assembly 69 (FIGS. 1, 2, 10, 11) for engaging the waist opening of a panty hose garment, to transfer the garment from the input section 10 of the machine to the discharge section 12 thereof.

Figure 4:
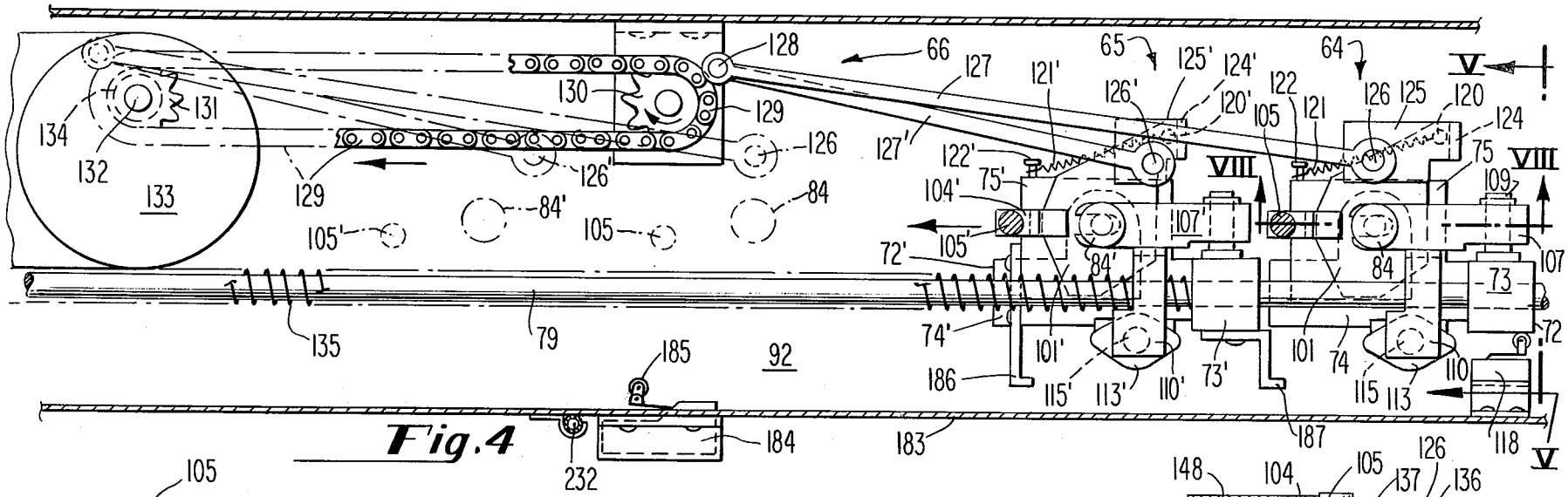
FIG. 4 is an enlarged, fragmentary view in section indicated by the arrows IV—IV of FIG. 2, showing a portion of the toe closing section of the machine.
Figure 5:
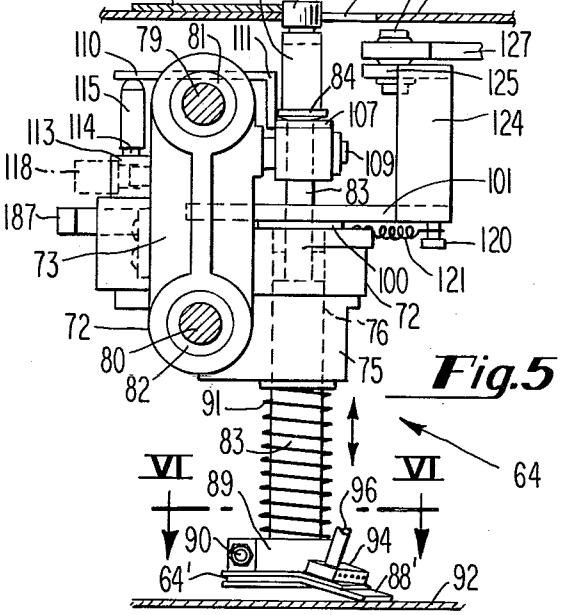
FIG. 5 is an enlarged, fragmentary view in section indicated by the arrows V—V of FIG. 4.

The construction of the toe clamp assemblies 64, 65 is illustrated in detail in FIGS. 4–8, inclusive. Referring specifically to FIGS. 4 and 5, clamp assembly 64 includes a generally L-shaped support casting 72 which has a vertical upstanding element 73 and a horizontal, transversely extending element 74. Extending laterally from the horizontal casting element 74 is a third casting element 75, having a vertical bore 76 formed therein. The top and bottom portions of the casting 72 are provided with spaced, horizontal bores which engage slidably with vertically spaced support rods 79, 80 mounted transversely of the toe closing section 11 of the machine. The upper bore of the casting 72 passes through the upper portion of the vertical casting element 73, and is provided with a bushing 81 which engages slidably with rod 79. The lower bore in the casting 72 passes through the lower portion of element 73 and completely through the horizontal casting element 74, and is provided with a bushing 82 for slidable engagement with the lower rod 80.

Figure 6:
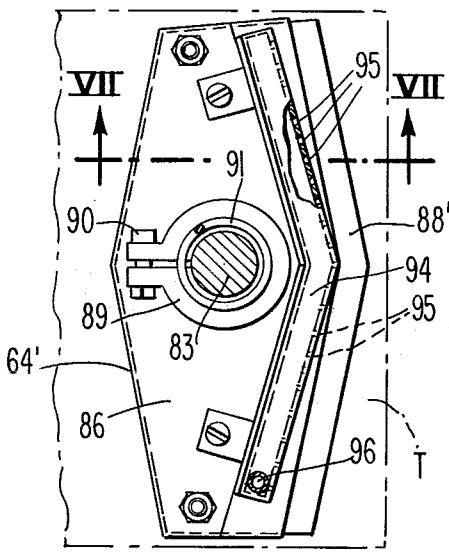
FIG. 6 is an enlarged, fragmentary view in section indicated by the arrows VI—VI of FIG. 5.
Figure 7:
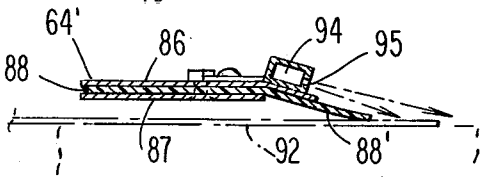
FIG. 7 is a sectional view indicated by the arrows VII—VII of FIG. 6.

Slidably disposed in the vertical bore 76 of the lateral casting element 75 is a verically movable clamp rod 83 provided with a flange or annular cap 84 at its upper end. Affixed to the lower end of rod 83 is the toe clamp 64'. As best shown in FIGS. 6 and 7, toe clamp 64' includes a pair of vertically spaced, generally horizontal metal plates 86, 87 which mount therebetween a fabric clamping element 88 composed of a generally flat, relatively stiff, but flexible, material preferably formed of plastic. As shown in FIG. 7, the front portions of the upper plate 86 and of the plastic sheet or element 88 are inclined downwardly.

Mounted on the top of the upper plate 86 is a vertical collar 89 by means of which the toe clamp 64' is secured to the lower end of the vertical rod 83 by any suitable securing means 90. A vertical coil spring 91 is mounted externally of the lower portion of clamp rod 83, between the top of collar 89 and the bottom of the lateral casting element 75. Spring 91 urges clamp 64' vertically downward, to engage the downwardly inclined, front edge area 88' of the plastic element 88 into fabric clamping contact with the upper surface of a horizontal support plate 92 extending transversely of the toe closing section 11 of the machine. The fabric clamping relation between the front, inclined edge area 88' of the plastic element 88 and plate 92 is illustrated in FIGS. 5–7.

Mounted on the top of the inclined front portion of upper clamp plate 86 is a hollow compressed air manifold 94 provided with a series of transversely spaced, downwardly inclined orifices 95, through which compressed air is discharged in the direction indicated by the arrows in FIG. 7. Manifold 94 is connected to a suitable source of compressed air (not shown) by means of a conduit 96. The compressed air system 94, 95, 96 applies a gentle external force to the clamped toe fabric to flatten the fabric.

Figure 8:
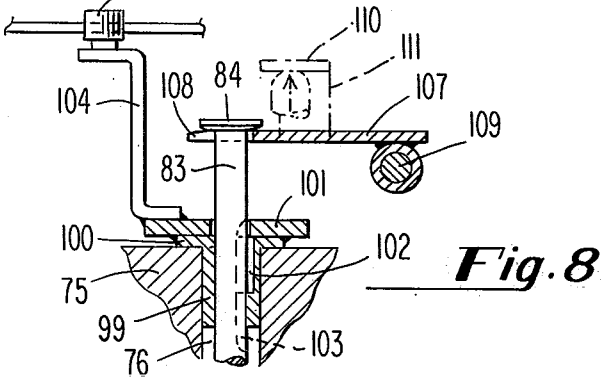
FIG. 8 is an enlarged, fragmentary view in section indicated by the arrows VIII—VIII of FIG. 4.

Referring now to FIG. 8, it will be seen that the upper end of the bore 76 in the lateral casting element 75 supports a hollow sleeve 99 having a flange 100 formed about its upper end. The flange 100 rests on top of the lateral casting element 75 to support sleeve 99 slidably within the bore. Welded to the top of the flange 100 is a flat, pivotal plate 101.

Secured internally of the sleeve 99 is a key 102 which engages slidably within an elongated, axially-extending keyway 103 formed in the upper portion of the clamp rod 83. The provision of the key 102 and the elongated keyway 103 permits clamp rod 83 to be moved vertically within bore 76 of the lateral casting element 75, to raise and lower toe clamp 64' relative to plate 92. At the same time, pivotal movement of plate 101 will be imparted to clamp rod 83, by means of key 102 and keyway 103, to cause clamp 64' to pivot angularly about the vertical axis of bore 76 and rod 83. Welded to the upper surface of plate 101 is a vertical bracket 104, to the upper end of which is mounted a vertical axis, cylindrical cam follower 105. As will be explained in more detail, cam follower 105 is actuated to impart pivotal movement to plate 101 which, via key 102 and keyway 103, is transmitted to clamp rod 83 and toe clamp 64'.

Clamp rod 83 is raised vertically, against the force of spring 91, by means of a vertically pivotal lever 107 having a bifurcated distal end 108 engaging rod 83 below cap 84. The proximal end of lever 107 is mounted to pivot about a horizontal axis rock shaft 109 forming part of casting 72, and extending horizontally from its vertical element 73 (FIGS. 4, 5). Disposed above transverse rod 79 (FIG. 5) is a horizontal, longitudinally extending lever 110 having a vertically depending portion 111 formed at one end thereof. The lower end of depending element 111 is rigidly secured to pivot lever 107 intermediate its distal and proximal ends. The pivotal lever 107 thus acts as a support for the horizontal lever 110.

A vertical axis pneumatic cylinder 113 (FIGS. 4, 5) is secured to the horizontal element 74 of the casting 72. The piston rod 114 of the pneumatic cylinder extends vertically upward and has a plunger 115 affixed at its upper end. The plunger is disposed adjacent the underside of the distal end of horizontal lever 110. When the pneumatic cylinder 113 is actuated, it moves plunger 115 vertically upward, as shown in phantom in FIG. 8, to raise lever 110. Due to its connection to the pivotal lever 107, by means of its depending element 111, the elevation of lever 110 causes lever 107 to pivot upward. Thus, actuation of the cylinder 113, causing its plunger 115 to advance upward against the lever 110, results in the retraction of clamp 64', against the force of the spring 91, away from the horizontal plate 92. When the cylinder is deactivated, and its plunger retracted downwardly, spring 91 then urges clamp 64' downward to force the downwardly inclined external edge 88' of plastic element 88 into clamping contact with plate 92.

The horizontal, pivotal plate 101 is provided with a depending stud 120 (FIGS. 4, 5) to which is connected one end of a coil spring 121, the opposite end of which is secured to a stud 122 affixed to the lateral casting element 75. By this arrangement, spring 121 urges plate 101 counterclockwise as viewed in FIG. 4. Pivotal plate 101 also is provided with an upstanding arm 124, at the upper end of which is formed a horizontally extending support element 125. Affixed to support element 125 is a vertical pivot 126.

Figure 10:
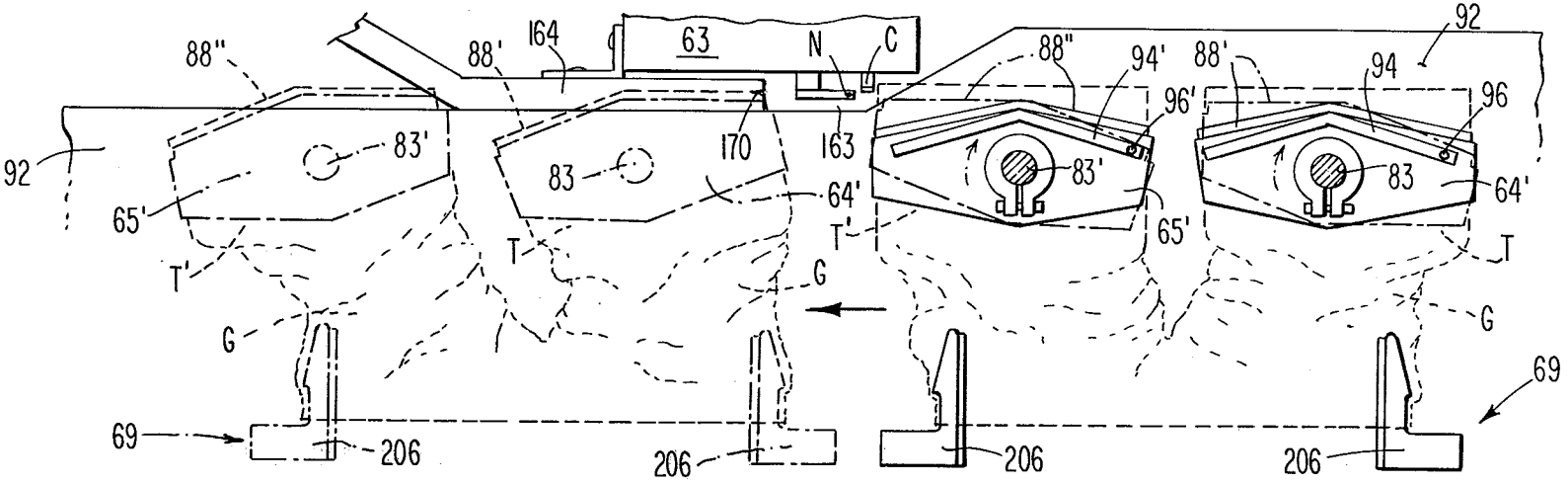
FIG. 10 is a fragmentary, partially schematic view in section, indicated by the arrows X—X of FIG. 2, showing another portion of the toe closing section of the machine.
Figure 11:
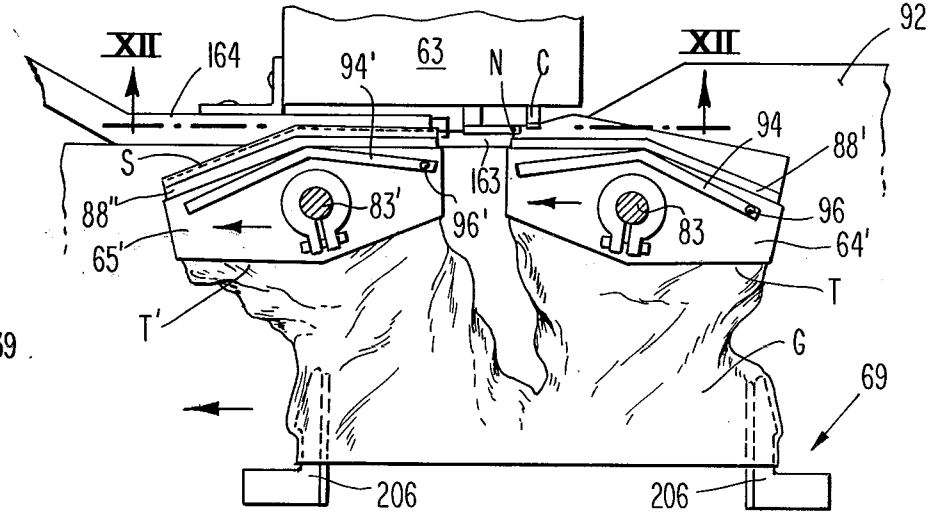
FIG. 11 is a fragmentary view similar to FIG. 10, illustrating the movement of the clamped toes of a panty hose garment relative to a seaming device for closing the toes.

The construction of clamp assembly 65, which supports retractable toe fabric clamp 65', is substantially identical to that of clamp assembly 64 (FIG. 4). More specifically, clamp assembly 65 includes a casting 72' having casting elements 73', 74', 75', a vertically movable clamp rod 83' (FIGS. 10, 11) provided with an annular cap 84', and an angularly pivotal plate 101' having a depending stud 120' and an upstanding arm 124', supporting a horizontal support element 125', to which is affixed a vertical pivot 126'. Clamp assembly 65 also includes vertically pivotal lever 107' having horizontal lever 110' affixed thereto, pneumatic cylinder 113' provided with a vertically movable plunger 115', cam follower 105' affixed to pivotal plate 101' by bracket 104' and coil spring 121' connecting stud 120' to stud 122' to urge plate 101' in a counterclockwise direction. Clamp 65' is of identical construction to clamp 64', including a flat plastic clamping element identical in function and structure to element 88, and having a downwardly inclined front edge portion 88'' (FIGS. 10, 11). Clamp assembly 65 also includes a verical coil spring (not shown) identical in structure and function to spring 91, to urge clamp 65' downward to force the downwardly inclined external edge 88'' of its plastic element into clamping contact with plate 92.

The clamp assemblies 64, 65 are shown in their start or initial position in FIG. 4. In that position, they receive and clamp the toe ends T, T' of the garment G between the clamp elements 88', 88'' and clamp plate 92, preparatory to the toe closing operation, as indicated by their solid line illustrations on the right-hand side of FIG. 10.

Referring back to FIG. 4, it will be seen that pivotal drive rods or links 127, 127' connect the vertical pivots 126, 126', respectively, of the clamp assemblies 64, 65 to a common pivot pin 128 mounted on, and extending vertically upward from, an endless, movable sprocket chain 129. The sprocket chain 129 is entrained about horizontally spaced sprocket wheels 130, 131, the latter of which is mounted on the drive shaft 132 of a motor 133. Rotation of the motor 133 causes the sprocket chain to move in the direction of the arrow illustrated in FIG. 4. Because of its connection by rods 127, 127' to the clamp assemblies 64, 65, the motor driven chain 129 imparts reciprocal movement to the clamp assemblies, transversely back and forth across the machine, slidably along the rods 79, 80. The forward stroke imparted to the clamp assemblies 64, 65 by the drive chain 129 causes the clamps 64', 65' to move transversely relative to the seaming device 63, in the manner illustrated in FIGS. 10 and 11, at a selected constant linear speed.

The location of the vertical pivot 126', relative to its clamp assembly 65, is slightly different from the location of the corresponding pivot 126 relative to its clamp assembly 64. Since the pivots 126, 126' are connected drivingly by their rods 127, 127' to the common pivot pin 128, it is necessary to adjust the location of pivot 126' transversely, in order to ensure properly timed and smooth reciprocatory movement to both clamp assemblies. The adjustment in transverse location of the pivot 126 permits a reduction in the transverse width of the horizontal support element 125'.

In practice, it is preferred that the return of the clamp assemblies 64, 65 to their start position be accelerated. This may be accomplished by mounting an overriding clutch 134, such as a Sprague clutch, in the hub of the sprocket wheel 131, and by mounting compression springs 135 externally of transverse rods 79, 80, between the casting 72' of clamp assembly 65 and the rear support for the rods 79, 80, which may be the rear wall 182 of the toe closing section 11 (FIG. 1). During the forward movement of the clamp assemblies 64, 65 the springs 135 are compressed. Upon the start of the return stroke of the clamp assemblies, the compression on the springs 135 is released. Because of the overriding clutch 134, the sprocket wheel 131, chain 129 and clamp assemblies 64, 65 override motor shaft 132, enabling the springs to accelerate the return of the clamp assemblies to their start position. As the clamp assemblies approach their start position, their rate of speed and that of the drive chain 129 drops to the normal rate of motor driven speed, whereupon clutch 134 picks up the load and completes the return stroke of the clamps. As the clamp assemblies come to rest in their start position, they actuate a microswitch 118 connected to the motor 133, to open the switch and stop the motor.

Figure 9:
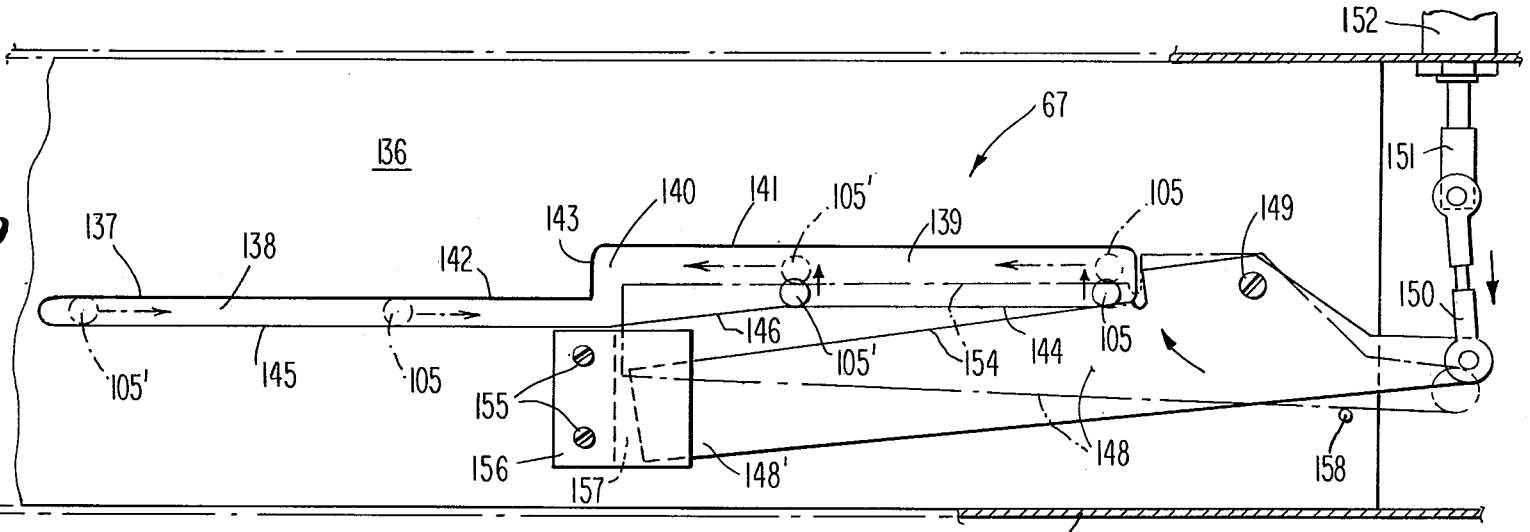
FIG. 9 is an enlarged, fragmentary view in section indicated by the arrows IX—IX of FIG. 2.
Figure 15:
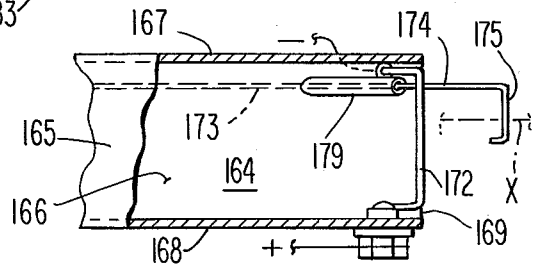
FIG. 15 is an enlarged, fragmentary, sectional view in plan indicated by the arrows XV—XV of FIG. 12, showing the trimmer.

Disposed above the clamp assemblies 64, 65, and their drive system consisting of motor 133, chain 129 and rods 127, 127', is the clamp guide cam assembly 67 (FIG. 2). Referring now to FIG. 9, it will be seen that the clamp guide cam assembly 67 includes a horizontal, transversely extending plate 136 having a transversely extending cam track 137 formed therein. Cam track 137 is composed of a relatively narrow segment 138, a somewhat wider segment 139 and an intermediate segment 140 of irregular shape. The cam track 137 is designed to receive the vertically extending cam followers 105, 105' disposed at the top of the cam assemblies 64, 65 (FIG. 5). Cam track segment 138 is of a width substantially approximating the diameter of the cam followers 105, 105'. Cam track segment 139 is of substantially greater width, and may be approximately twice the width of cam track segment 138. The intermediate cam track segment 140 gradually increases in width, from its juncture with cam track segment 139 to just in advance of where it communicates with the cam track segment 138, at which location its width becomes uniform.

The cam track 137 is provided with longitudinally offset, transverse cam edges 141, 142 which are joined by a short, longitudinal cam edge 143. The opposite side of cam track 137 is provided with longitudinally offset, transversely extending cam edges 144, 145 which are connected by an inclined cam edge 146.

A cam plate 148 is mounted above plate 136, with capacity to be pivoted in a horizontal plane about pivot 149. One end of pivotal cam 148 is attached by a link 150 to the external portion of a piston rod 151 of a pneumatic cylinder 152. When the cylinder 152 is actuated to advance its piston, cam plate 148 is caused to pivot clockwise, about its pivot 149, to the shadow line position shown in FIG. 9. As the result of such pivotal movement, cam plate 148 is superimposed over portions of the cam track segments 139, 140, to re-shape their configurations.

The pivotal cam plate 148 is provided with a cam edge 154. When cam plate 148 is caused to pivot over cam track segments 139, 140, its cam edge 154 is advanced to the transverse, shadow line position shown in FIG. 9. As a result, the cam tracks 139, 140 are reduced to a width approximating, or slightly larger than, the diameters of the cam followers 105, 105'. The cam track segment 140 is re-shaped to form a short, longitudinally extending cam track, providing a right-angled connection between cam track segment 138 and reduced cam track segment 139.

Mounted on the top of plate 136 by suitable securing means 155 is a bracket 156 having a longitudinally extending recess 157 formed in its underside, to provide a guide for the angularly movable distal end 148' of the pivotal cam plate 148. A stop 158 may be mounted on the upper surface of plate 136 to limit pivotal movement of cam plate 148, thereby ensuring proper transverse location of cam edge 154 in relation to cam track segments 139, 140.

Disposed above the clamp guide cam assembly 67 (FIG. 2) is a transversely extending, removable cover 160.

The purpose of the clamp guide cam assembly 67 is to impart precisely controlled, identical pivotal or angular movements to the clamps 64', 65', to produce identical toe closing seams in the toes T, T' in the garment G. The coil springs 121, 121', as explained previously, urge the pivotal plates 101, 101' in a counterclockwise direction as view in FIG. 4, and also in FIG. 9. As a result, the springs 121, 121' yieldingly urge the cam followers 105, 105' against the cam track edges 144, 145, 146, when cylinder 152 and cam plate 148 are retracted.

When pivotal cam 148 is retracted and cam followers 105, 105' are in contact with cam edge 144, and aligned transversely of the machine (FIGS. 4, 5, 8, 9), the clamps 64', 65' are disposed in their normal position, with their long axes aligned transversely of the machine, as shown in solid lines in FIG. 10. This is the position which the clamps 64', 65' are caused to assume in advance of receiving and clamping the toe ends of a garment, delivered from input section 10, preparatory to the toe closing operation. At such time, the transversely aligned clamps also have been raised to an elevated, garment receiving position, by the activation of their pneumatic cylinders 113, 113', as will be more fully explained.

When cylinder 152 is activated to advance pivotal cam 148 clockwise about pivot 149, the cam followers 105, 105' are caused to pivot clockwise, against the force of springs 121, 121', to their shadow line positions shown in FIG. 9. Because of this pivotal movement, horizontal plates 101, 101', vertical clamp rods 83, 83' and clamps 64', 65' are caused to pivot angularly in the clockwise direction. As a result, clamps 64', 65' assume the angular positions illustrated by their shadow lines in the right-hand portion of FIG. 10. Such angular positions of the clamps 64', 65' are assumed after they have descended to clamp the toe fabrics T, T' preparatory to advancing the fabrics to the toe closing device 63.

The seaming device 63 may be any conventional, multithread sewing machine designed for closing the toes of hosiery. It includes the usual movable needle N and one or more loopers (not shown) which cooperate to form a chain of stitches for closing toe fabrics by sewn seams S (FIG. 11). It also includes the usual cutting blade C to trim the excess fabric from the toe ends of the garment during seaming. To adapt the sewing machine 63 to meet the high speed production of the toe closing machine of this invention, the usual fabric feed dogs are eliminated, the speed of the sewing machine increased beyond normal operating speeds and suitable oil cooling means (not shown) are provided.

Referring to FIGS. 12–15, the structure and operation of fhe novel, automatic stitch chain trimmer 68 of this invention now will be described. Clamping plate or element 92 is reduced in width in advance of the seaming means 63 to provide a clearance or opening 163 in front of the seaming device (FIG. 10). Into this opening, for discard, drop the pieces or ends of toe fabrics trimmed by the cutter C during the seaming operation (FIG. 11).

Mounted in the clearance 163, adjacent the sewing machine 63, is a preferably rectangular vacuum conduit 164. The conduit is provided with spaced, horizontal top and bottom walls 165, 166, and with spaced, vertical side walls 167, 168. The upper surface of the top wall 165 is disposed in the same horizontal plane as the upper surface of the clamp plate 92. The conduit 164 is provided with an open end 169 downstream from the needle N, i.e., it is spaced from the needle N in the direction of travel of the toe portions T', T of the garment G. A notch 170 (FIG. 14) is formed in the top wall 165 of the conduit, above the opening 169. The notch 170 is disposed to be in alignment with the seam S as it is produced in the toe fabrics, as the fabrics advance past the sewing machine 63 (FIGS. 10, 11).

Disposed transversely of the vacuum conduit 164, at the top of its opening 169, adjacent the front edge of top wall 165, is an incandescent wire 172 connected by suitable circuitry to a conventional voltage source (not shown). When an electric current is passed through wire 172, it is heated preparatory to severing the chain of stitches X produced by the sewing machine.

The stitch chain trimmer assembly 68 includes an elongated retractable guide wire 173 having an upper end 174 formed into a hood-like element 175. The lower end 176 of wire 173 is affixed to the external portion of a piston rod 177 of a pneumatic cylinder 178. Wire 173 is supported for sliding axial movement by an arcuate conduit 179, extending through the bottom wall 166 of the vacuum conduit 164, and by axially spaced apertures 180 formed in the depending portions of a bracket 181 affixed to the lower surface of the bottom conduit wall 166.

Figure 12:
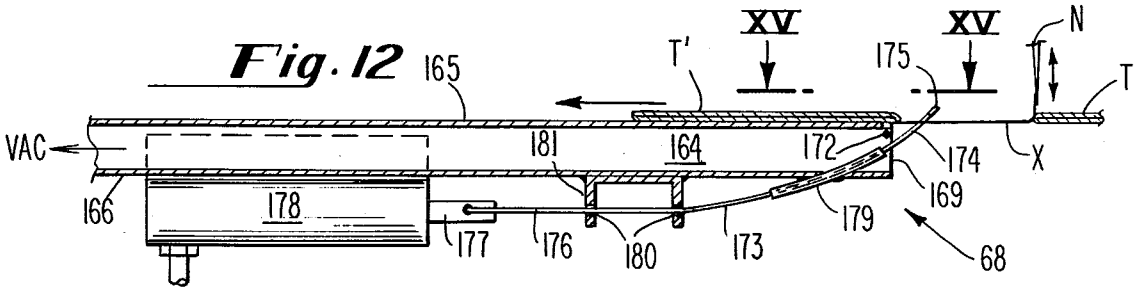
FIG. 12 is an enlarged, fragmentary view in section indicated by the arrows XII—XII of FIG. 11, showing the automatic trimmer of this invention for cutting the chain of seaming stitches adjacent the toe fabrics.
Figure 13:
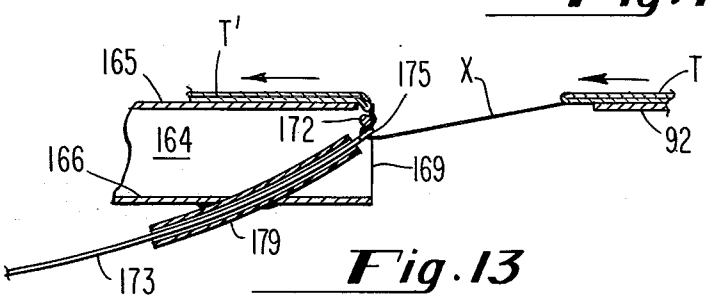
FIG. 13 is an enlarged, fragmentary view in section showing the trimmer in the process of cutting the chain of stitches adjacent the trailing edge of a seamed toe.
Figure 14:
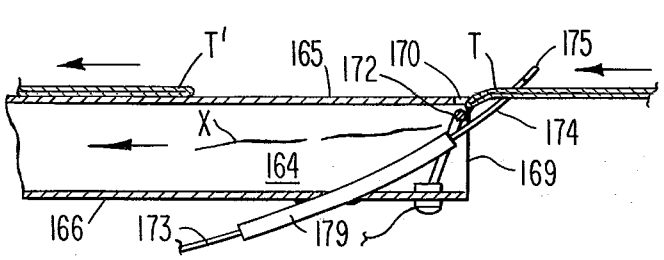
FIG. 14 is a view similar to FIG. 13 showing the trimmer in the process of cutting the chain of stitches adjacent the leading edge of a seamed toe.

Wire 173 normally is disposed in the advanced position shown in FIG. 12, with its hook 175 positioned above the toe fabrics T', T and the chain of stitches X. When the cylinder 178 is actuated, it retracts its piston rod 177, thereby retracting wire 173 axially relative to conduit 179 and apertures 180. As a consequence, the hooked end 175 of wire 173 engages the chain of stitches X and pulls it into the opening 169 of the conduit 164, and into contact with the heated wire 172, thereby severing the stitch chain (FIG. 13). The severed end of the stitch chain X is sucked into the vacuum tube 164 (FIG. 14).

Pneumatic cylinder 178 is controlled by a one-way microswitch 184 (FIGS. 1–4), which may be mounted on a transverse vertical wall 183 of the toe closing section 11 of the machine. Switch 184 is provided with a one-way retractable actuating arm 185 (FIG. 4) which is disposed in the transverse path of travel of a pair of horizontally spaced, laterally extending switch actuators 186, 187 affixed to casting 72' of clamp assembly 65. Each actuator or projection 186, 187 is adapted to strike switch actuator arm 185 on the forward stroke of clamp assembly 65, to close switch 184 momentarily, thereby energizing the circuit to stitch chain trimmer cylinder 178. As a result, cylinder 178 retracts wire 173, whereby its hook 175 pulls the stitch chain X into contact with the incandescent chain severing wire 172. Because of the one-way construction of actuating arm 185, the lateral projections 186, 187 do not actuate switch 184 on the return stroke of cam assembly 65.

Garment Removal

Figure 3:
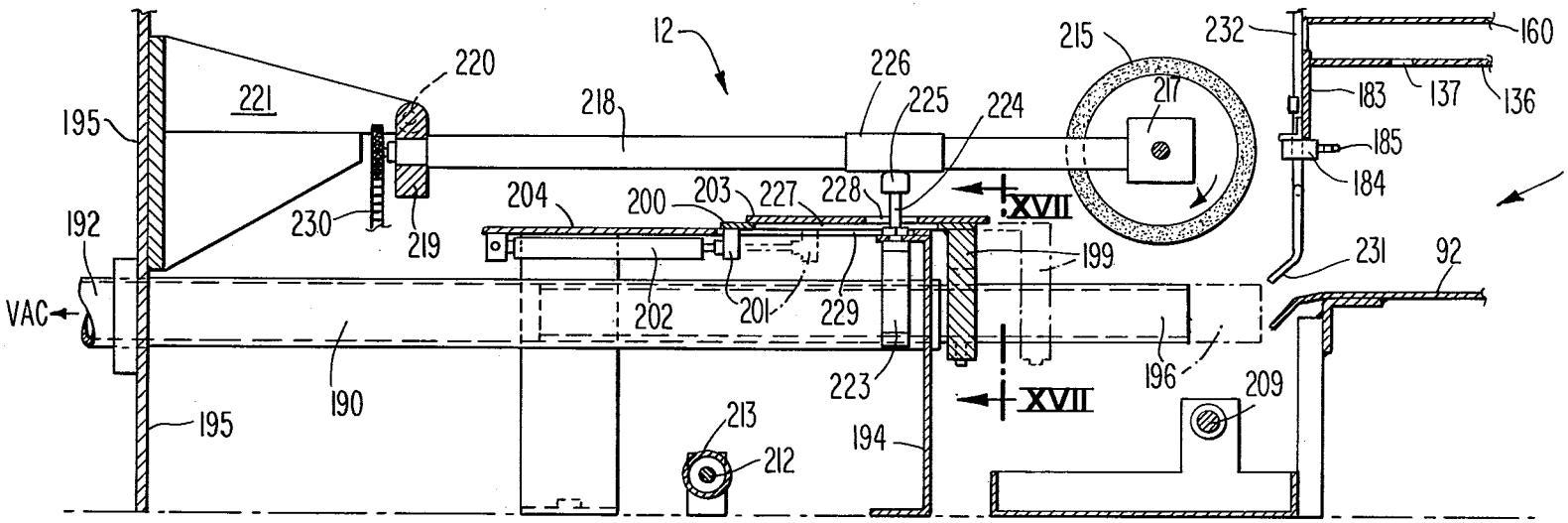
FIG. 3 is a sectional view in elevation indicated by the arrows III—III of FIG. 1, showing the garment discharge section of the machine.
Figure 17:
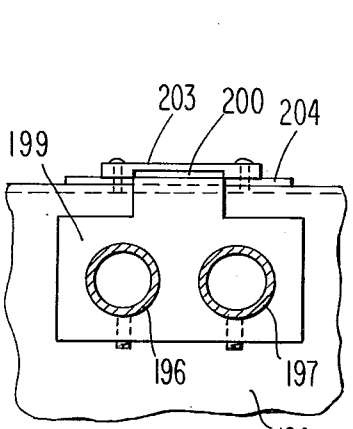
FIG. 17 is a fragmentary view in section indicated by the arrows XVII—XVII of FIG. 3, showing the preferred axially movable garment receiving tubes of the discharge section of the machine.

As illustrated in FIGS. 1, 3 and 17, the garment discharge section 12 includes a pair of horizontal, transversely spaced, stationary vacuum tubes 190, 191 connected at their respective rear ends 192, 193 to a suitable vacuum or suction source (not shown). The forward ends of the tubes 190, 191 are supported by a vertical transverse support 194, and their rear ends 192, 193 are supported by the vertical, transversely extending wall 195. Mounted telescopically within the forward ends of the stationary vacuum tubes 190, 191 are, respectively, axially movable vacuum tubes 196, 197. Tubes 196, 197 are slidable in fluid-tight relationship within stationary tubes 190, 191.

The slidable vacuum tubes 196, 197 are advanced axially, to and from the toe closing section 11, by means of a transverse yoke 199 secured to the movable tubes. Yoke 199 is affixed to the undersurface of the forward end of a flat, horizontal slide 200, the rear end of which is affixed to the distal end of a piston rod 201 extending from a pneumatic cylinder 202. The longitudinal movable plate 200 is disposed slidably between vertically spaced, horizontal plates 203, 204. When the cylinder 202 is activated, it advances its piston rod 201 to advance slide 200, yoke 199 and movable vacuum tubes 196, 197 to the forward position, relative to toe closing section 11, indicated by the shadow lines in FIG. 3. The slidable vacuum tubes 196, 197 are advanced to receive the garment G following the closing of its toes.

The machine is provided with a garment transfer assembly 69 similar in construction to that shown in U.S. Pat. No. 3,875,880, aforesaid. The transfer assembly 69 includes the usual finger assembly 205 designed to be rocked about transverse shaft 209 to the vertical position shown in shadow lines in FIG. 2. As the finger assembly 205 is rocked to its vertical position, its individual fingers 206, 207 spread or separate vertically preparatory to transferring the waist opening of the garment from the input section 10 of the machine to the discharge section 12. The transfer assembly 69 includes a pneumatic cylinder 208 for rocking shaft 209, to elevate the fingers 206, 207. The assembly also includes the usual slidable yoke 210 mounted on shaft 209, and connected by a pivotal lever 211 to the distal end of a piston rod 212 extending from a pneumatic cylinder 213. When cylinder 213 retracts its piston rod 212, yoke 210 is caused to slide on shaft 209, transversely of the machine, to transfer the finger assembly 205 from the input section 10 of the machine to the discharge section 12 thereof. Since the transfer assembly 69 is substantially similar in structure, operation and function to that disclosed in U.S. Pat. No. 3,875,880, further detailed description thereof is unnecessary.

After the transfer assembly 69 has transferred the waist portion of the garment to the discharge section 12, the slidable vacuum tubes 196, 197 are advanced by their cylinder 202 to enter the waist opening of the garment, whereupon the fingers of the finger assembly 205 are withdrawn from the garment, and the transfer assembly 69 is returned to its starting position.

Disposed above the slidable vacuum tubes 196, 197 are, respectively, transversely spaced, foam rimmed wind-on wheels 215, 216, rotatable in the direction of the arrow shown in FIG. 3. The wheels 215, 216 are affixed to shafts driven from a gear box 217, the outer casing of which is mounted on the distal end of an elongated, hollow tube 218. The proximal end of tube 218 is secured within a collar 219 pivotal about a horizontal, transverse pivot 220 supported by a bracket 221 affixed to rear transverse wall 195 of the machine. The wind-on wheels 215, 216 normally are retained in the elevated position shown in FIG. 3, above the slidable garment support tubes 196, 197.

The wind-on wheels 215, 216 are pivotal downwardly, about pivot 220, to bring their peripheries into frictional engagement with the tubes 196, 197, by means of a pneumatic cylinder 223 having a piston rod 224, the distal end 225 of which is affixed to sleeve 226 mounted externally of tube 218. Clearance for the piston rod 224 is provided by elongated slot 227 formed in slide 200, and by suitable openings or apertures 228, 229 formed, respectively, in the spaced horizontal plates 203, 204.

The wind-on wheels 215, 216 are driven continuously by means of the motor 57 through a conventional sprocket wheel and chain drive 230. The latter is connected drivingly to a shaft disposed intenally of the hollow tube 218, and connected to the gearing in the gear box 217, from which rotation is imparted to the wind-on wheels 215, 216. The period of time during which the wind-on wheel 215, 216 are maintained in their depressed position, in frictional contact with the tubes 196, 197, is determined by the setting of a conventional electric timer (not shown).

The purpose of the wind-on wheels 215, 216 is to mount the garment G completely on the support tubes 196, 197 following the toe closing operation. To assist wheels 215, 216 in this regard, a compressed air nozzle 231 may be disposed adjacent the forward ends of the garment receiving tubes 196, 197. Nozzle 231 is operative to direct a blast of compressed air in the direction of the crotch area of the garment, to ensure that its waist area is disposed on tubes 196, 197 below the wind-on wheels 215, 216. Compressed air nozzle 231 is connected to a source of compressed air (not shown) by means of a conduit 232 affixed to the outer surface of the transverse wall 183.

The Sequence of Operation

The machine illustrated in the drawing is operated automatically under the control of a motor-driven sequence programmer which controls the automated operation of the machine by means of conventional cams, electric timers and switches and solenoid-controlled pneumatic valves. These parts are conventional control mechanisms, and for this reason are not fully illustrated in the drawing.

In the preferred sequence of operation, with the garment disposed right side out, the operator places each toe end into the open end of one of the vacuum tubes 18, 18'. The vacuum draws the legs down the tubes until the crotch portion of the garment bridges the gap between the two tubes. The operator then inverts the waist opening inside out over the outside of the two leg assemblies 15, 16 far enough to dispose the waist area over the wind-on wheels 43, 44, 43', 44'. After aligning the garment on the two assemblies, the operator then actuates a switch (not shown) which shuts off the vacuum within the tubes 18, 18' and causes the wind-on wheels 43, 44, 43', 44' to elevate into frictional contact with the blades of their respective leg assemblies. The wind-on wheels draw the legs of the garment out of the tube, and dispose the garment inside out on the leg assemblies 15, 16, with each leg assembly within one of the legs of the garment.

The operation of the wind-on wheels 43, 44, 43', 44' is timed so that the garment is mounted over the leg assemblies with its toe ends disposed proximate the open ends of the tubes 18, 18'. The waist opening is in contact with the stops 40, 41, 40', 41' of the leg assemblies. The operator then properly aligns the toe portions T, T' on the leg assemblies 15, 16, following which the operator actuates the main operating switch (not shown) of the machine to commence its automated cycle of operation. From this point, the operation of the machine is completely automatic.

With the clamps 64', 65' in their elevated positions, under the influence of their cylinders 113, 113', the cylinder 35 causes the blades 23, 24, 23', 24' of the leg assemblies 15, 16 to advance to the shadow line position illustrated in FIG. 2, with the toe ends T, T' positioned, respectively, below the open clamps 64', 65'. The cylinders 113, 113' are deactivated, whereupon the coil springs disposed about the vertical clamp rods 83, 83' force the clamps downward, against the distal ends of the blades 23, 24 23', 24' to clamp the toes T, T'. Pneumatic cylinder 35 then causes the blades to retract to their normal position, shown in FIG. 1, leaving the toe ends of the garment clamped by clamps 64', 65' between their inclined, plastic front edge portions 88', 88'' and the upper surface of the fabric support plate 92 (FIGS. 5, 6, 10).

Near the end of the forward movement of the blades 23, 24, 23', 24', the garment transfer assembly 69 is activated to elevate its fingers 206, 207 to enter the waist opening of the garment (FIGS. 2, 10, 11). The fingers of the transfer assembly are caused to separate vertically, to support the garment in its waist area after the blades 23, 24, 23', 24' have been withdrawn to their retracted position.

Immediately following retraction of the blades, cylinder 152 (FIG. 9) is activated to pivot cam 148 to advance its cam edge 154 over cam track segments 139, 140, thereby advancing clamps 64', 65' angularly preparatory to the toe closing operation (FIG. 10).

Motor 133 then is started, to advance the clamp assemblies 65, 64 transversely across the machine, past the sewing machine 63. As the clamp assemblies begin to move, compressed air passes through conduits 96, 96', manifolds 94, 94', and their orifices, to cause jets of compressed air to be blown onto the open ends of the clamped toe fabrics T, T', to flatten the fabrics as they are advanced for seaming (FIGS. 7, 10). Jets of compressed air are directed onto the toe ends of the fabrics, to maintain the fabrics in flat condition, throughout the toe closing operation.

The motor 133 causes the clamped toe fabrics to advance over clamp plate 92, transversely past the sewing machine 63, at a constant linear rate of speed, so as to close the toes with a seam of constant stitch density. In practice, a linear speed of approximately 5.4 inches per second may be employed. As the clamp assemblies 65, 64 advance across the machine, their cam followers 105', 105 (FIG. 9) move in the cam track 137. Up to the point where the cam followers 105', 105 enter the short, reduced cam track segment 140, the clamps 65', 64' are maintained in their angularly advanced position illustrated by the shadow lines of the right hand portion of FIG. 10. After the cam followers 105', 105 enter cam track segment 140, they contact successively the longitudinal cam edge 143. When this occurs, the forward movement of their respective clamps 65', 64' stops momentarily. But their drive rods 127', 127 continue to advance with chain 129. Since the rods 127', 127 are connected to pivotal plates 101', 101 by means of pins 126', 126, the continued advance of rods 127', 127 causes the plates to pivot successively counteclockwise, about their respective vertical rods 83', 83. As a result, clamps 65', 64', and their respective clamped toe fabrics T', T, are caused to assume the reverse angular positions shown by their shadow line representations in the left hand portion of FIG. 10. In practice, it is preferred that the total angular displacement of the clamps 65', 64' from their advanced pivotal position illustrated to the right of FIG. 10, to their reverse pivotal position illustrated to the left thereof, be on the order of 50°.

As clamps 65', 64' and their respective toe fabrics T', T complete their successive reverse arcuate movements, the cam followers 105', 105 pass from the cam track segment 140 into transverse cam track segment 138, and advance to their respective shadow line positions shown in FIG. 9. The arcuate movements of the clamps 65', 64', and the seaming of the toes T', T of the garment G, are illustrated schematically in FIGS. 10 and 11, The re-shaped short, longitudinal cam track segment 140 is located in cam plate 136 to alter successively the movements of cam followers 105', 105 so as to cause clamps 65', 64' to pivot along a circular arc, the radius of which extends from the vertical axis of clamp rods 83', 83 to the sewing machine 63. Thus, cam track 137 and pivotal cam 148 cooperate to cause the reverse angular or pivotal displacement of clamps 65', 64' to produce identical fish-mouth type seams in the toe ends T', T of the garment G.

As the toe fabrics T', T are moved by the clamps 65', 64' across clamp plate 92, past sewing machine 63, the excess fabric is trimmed by the cutter C and is discarded, while seam S is sewn to close the toe ends of the garment G (FIG. 11).

As the toe fabrics T', T travel past the sewing machine 63, the stitch chain trimmer 68 is operative automatically to trim the chain of stitches, produced by the sewing machine, closely adjacent to the leading and trailing edges of the toe fabric. As the trailing edge of the toe fabric T' approaches the opening 169 of vacuum conduit 164, hook 175 pulls the chain of stitches X into contact with the incandescent wire 172 to trim stitch chain X close to the fabric T' (FIGS. 12, 13). The cut end of the stitch chain X is sucked into the vacuum tube 164. As the leading edge of the toe fabric T approaches the vacuum tube opening 169, the free end of the stitch chain X attached to its leading edge is brought into contact with the heated wire 172, and severed close to the fabric (FIG. 14). Notch 170 formed in the top wall 165 of the conduit 164 acts as a guide for the stitch chain X, during its severing, to aid in cutting the stitch chain closely adjacent to both the leading and trailing edges of the toe fabric. The severed ends of the stitch chain X are sucked up the vacuum conduit 169 to a waste collector (not shown).

The sewing machine 63 starts and stops automatically, under the control of the sequence programmer, during the toe closing operation. Meanwhile, the garment transfer assembly 69 transfers the open waist area of the garment G to the garment discharge section 12 of the machine. The movable vacuum tubes 196, 197 are advanced to enter and receive the waist opening of the garment. The fingers 206, 207 of the garment transfer assembly 69 then are retracted from the garment, and assembly 69 is returned to its start position.

After the clamp assemblies 65, 64 have moved the clamped toe fabrics T′, T past the sewing machine 63, to complete the seaming operation, the pneumatic cylinders 113′, 113 raise the clamps 65′, 64′ to release the toe fabrics, and cylinder 152 retracts pivotal cam 148. The clamp assemblies 64, 65 then are returned rapidly to their start position, with their clamps 64′, 65′ elevated above plate 92, in preparation for the next operative cycle of the machine.

As soon as the toes T, T′ are unclamped, a blast of compressed air is discharged from nozzle 231 in the direction of the crotch area of the garment G on the tubes 196, 197, to position the waist area of the garment under the wind-on wheels 215, 216. The wind-on wheels 215, 216 are advanced to the tubes 196, 197 to complete the mounting of the garment on the tubes, with each of the tubes disposed within one of the legs of the garment. Since the toes T, T′ of the garment now are closed, axial advance of the garment onto the tubes 196, 197 is arrested when the closed toes contact the open ends of the vacuum tubes 196, 197.

Upon completion of the mounting of the garment on the tubes 196, 197, suction is applied internally of the tubes, causing the toe and leg portions of the garment to be sucked into the tubes on which they are mounted. The toe and leg portions of the garment are sucked completely into the tubes, turning them right side out in the process. Advancement of the garment into the tubes 196, 197 is arrested when its crotch area comes into contact with the open ends of the tubes. At this point, suction is removed from within one of the tubes 196, 197 while maintained in the other, and the entire garment is withdrawn into the latter tube. As it passes into that tube, its pant portion is turned right side out and the garment is transferred to a garment collector (not shown). The garment, now fully inverted right side out, is completely finished and ready for packaging.

Thus, as the result of the invention disclosed herein, it is possible to provide a novel, automated machine and method for closing the toes of panty hose type garments rapidly and accurately to produce identical toe closing seams. Because of the high speed, precision controlled toe closing operation, important economic benefits are achieved, both by the rapidity of production and by the accuracy and quality of the toe closing results produced. Although a preferred embodiment of this invention has been shown and described for the purpose of illustration, as required by Title 35 U.S.C. 112, it is to be understood that various changes and modifications may be made therein without departing from the spirit and utility of this invention, or the scope thereof as set forth in the appended claims.

We claim:

1. A method of closing the toe ends of a bifurcated garment having waist, pant, leg and toe fabric portions comprising the steps of:

a. mounting the garment inside out on a pair of laterally spaced leg supports, b. advancing the garment to a first location and clamping the toe portions at laterally spaced positions by separate clamps, while removing the garment from the leg supports and depositing the waist portion on a garment transfer means, c. angularly advancing the clamped toe portions along substantially identical arcuate distances, d. applying jets of compressed air to each of the clamped toe portions to flatten the fabrics of the toe ends, e. transferring the garment, while maintaining the toe portions clamped, from the first location to a second location, and positioning the waist portion at the second location proximate the open ends of a pair of laterally spaced suction tubes, f. closing the flattened fabrics of the toe ends by substantially indentical toe closures, as the garment is transferred from the first to the second location, by successively advancing the clamped toe portions relative to a toe closing means at a selected rate of speed, g. angularly retracting each clamped toe portion along substantially identical arcuate distances as it is closed, to provide curved toe closures in the toe ends of the garment, h. unclamping the closed toe portions and mounting the garment inside out on the suction tubes, with each tube disposed within one of the legs of the garment, i. turning the garment right side out by drawing the garment into the suction tubes and j. transferring the garment internally of one of the suction tubes to a garment depository.

2. A method of closing the toe ends of a bifurcated garment having waist, pant, leg and toe fabric portions comprising the steps of:

a. mounting the garment inside out on a pair of parallel supports, b. advancing the garment to a first location and clamping the ends of the toe portions at laterally spaced positions, while removing the garment from the supports and depositing the waist portion on a garment transfer means, c. transferring the garment, while maintaining the toe portions clamped, from the first location to a second location, and positioning the waist portion at the second location proximate the open ends of a pair of parallel suction tubes, d. successively closing the ends of the toe portions by substantially identical toe closures as the garment is transferred from the first to the second location, e. unclamping the toe portions and mounting the garment externally of the suction tubes, with each tube disposed within one of the garment legs, f. turning the garment right side out by drawing the garment into the suction tubes and g. transferring the garment internally of one of the suction tubes to a garment depository.

3. The method of claim 2, further including the steps of:

a. forming a seam of stitches along a predetermined line of each toe portion to close the toe ends by substantially identical toe closures and b. applying a gentle external force to each of the clamped toe portions to flatten the fabrics of the toe ends prior to and during formation of the seam.

4. The method of claim 2, further including the steps of:

a. closing the ends of the clamped toe portions by advancing the garment at a selected rate of linear speed relative to a seaming means producing a continuous chain of stitches, b. angularly displacing each clamped toe portion as it is closed by the seaming means to provide curved toe closures in the toe ends of the garment and c. coordinating the linear and arcuate movements of each clamped toe portion, relative to the seaming means, to produce substantially identical toe closures of substantially uniform stitch density.

5. A machine for closing the toe ends of a bifurcated garment having waist, pant, leg and toe fabric portions, comprising:

a. support means for mounting the garment inside out, with its legs disposed in substantially spaced, parallel relation, b. a pair of spaced clamps, c. pneumatic means operative to open the clamps and retain the clamps in open position, d. means to advance and retract the support means toward and away from the clamps, said means being operative to locate the toe ends of the garment under the open clamps, e. spring means operative to close the clamps to clamp the toe ends, f. transfer means for receiving the waist area of the garment from the support means, g. second support means for supporting the garment inside out with its legs disposed in substantially spaced, parallel relation, h. means for transferring the garment, while the toe ends are clamped, to a location proximate the second support means, i. toe closing means for successively closing by seams the toe ends of the garment as it is transferred, j. means for imparting selected arcuate movements to the clamped toe ends to produce curved seams in the toe ends, k. compressed air means operative to maintain each of the fabrics of the clamped toe ends flat during closure by the toe closing means, l. means automatically operative, following the transfer of the garment, to mount the garment inside out on the second support means, and m. suction means associated with the second support means for turning the garment right side out and transferring the garment to a depository.

6. The machine of claim 5, further including:

a. a toe closing means for closing the toe ends by seams composed of a continuous chain of stitches, b. stitch chain severing means located adjacent the toe closing means, c. retractable guide means operable to bring the stitch chain into engagement with the severing means to sever the chain, d. an actuator for the guide means and e. control means for the actuator operable to cause the guide to bring the stitch chain into engagement with the severing means at selected intervals to sever the stitch chain adjacent the clamped toe ends.

7. The machine of claim 6, further including:

a. means for advancing the clamps and their respective clamped toe ends relative to the toe closing means at a selected constant rate of speed, to close the toe ends by seams of substantially uniform stitch density and b. means for retracting the clamps relative to the toe closing means at an accelerated rate of speed.

8. In a machine for closng the toe ends of a bifurcated garment having waist, pant, leg and toe fabric portions, a. a sewing machine for uniting superimposed layers of fabric by a seam composed of a continuous chain of stitches, b. a pair of spaced clamps normally disposed in advance of the sewing machine, c. means to close the clamps to clamp separately the ends of the toe portions of the garment preparatory to closure thereof, d. means to advance successively the clamps and their clamped toe portions relative to the sewing machine to form substantially identical toe closure seams in each toe end of the garment, e. a stitch chain severing means located adjacent the sewing machine, f. a guide operable to bring the stitch chain into engagement with the severing means to sever the chain, g. timed actuator means for the guide operable to cause the guide to bring the stitch chain into engagement with the severing means to sever the chain proximate each toe fabric, h. means to open the clamps to unclamp the toe portions of the garment, following closure of the toe ends, and i. means to return the clamps while open to a position in advance of the toe closing means.

9. The machine of claim 8, further including compressed air means associated with each of the clamps operative to direct compressed air on the clamped toe portions, to maintain the fabrics of the toe ends flat as they advance relative to the toe closing means.

10. The machine of claim 8, further including:

a. an actuator for the guide controlled by the location of the fabrics of the toe ends of the garment relative to the sewing machine, b. sensing means operable to detect the location of the fabrics of the toe ends and c. control means for the actuator responsive to the sensing means and operable to activate the actuator at selected time intervals to cause severing of the stitch chain after each toe end has been closed.

11. The machine of claim 8, further including:

a. pneumatic means to open the clamps and b. spring means operative to close the clamps when the pneumatic means are inoperative.

12. The machine of claim 5, wherein the second support means includes:

a. a pair of laterally spaced, open ended, axially movable suction tubes and b. means for advancing the suction tubes to enter the waist portion of the garment.

13. The machine of claim 12, wherein the means for mounting the garment on the second support means includes:

a. a source of compressed air and b. rotatable wind-on wheels, c. said source of compressed air and said wheels being operable to mount the garment on the suction tubes with each tube disposed within one of the legs of the garment.

14. The machine of claim 13, further including:

a. a compressed air jet operable to cause the garment to be installed on the suction tubes proximate the wind-on wheels and b. means to advance and retract the wind-on wheels to and from the suction tubes, c. said wind-on wheels being operable, in their advanced position, to mount the garment on the suction tubes with the closed toe ends of the garment engaging the open ends of the suction tubes.

15. The machine of claim 14, further including suction means associated with the suction tubes for turning the garment right side out and transferring the garment to a depository.

16. The machine of claim 8, further including:

a. means for advancing the clamped toe portion relative to the sewing machine at a selected rate of speed, to close the toes by seams of substantially uniform stitch density, and b. means for returning the clamps to their advanced position at an accelerated rate of speed.

17. The machine of claim 8, further including:

a. means to pivot the clamps and their clamped toe fabrics to a first angular position following clamping of the toe portions of the garment and b. means to pivot the clamps and their clamped toe fabrics to a second angular position as the clamped toe portions advance relative to the sewing machine, c. said second clamp pivoting means being operable to move the clamped toe fabrics to the second angular position during formation of the toe closure seams.

18. In a machine for closing the toe ends of a bifurcated garment having waist, pant, leg and toe fabric portions, a. a toe closing means, b. a pair of spaced clamps normally disposed in advance of the toe closing means, c. means to close the clamps to clamp separately the ends of the toe portions of the garment preparatory to closure thereof, d. support means for mounting the garment with its legs disposed in laterally spaced relation, e. actuating means for advancing and retracting the garment support means toward and away from the clamps, f. magnetic means connecting the garment support means to its actuating means, g. said magnetic means being operable to disconnect the actuating means from the garment support means in the event the support means encounters an obstacle as it advances toward the clamps, h. means to advance successively the clamps and their clamped toe portions relative to the toe closing means to form substantially identical toe closures in each toe end of the garment, i. means to open the clamps to unclamp the toe portions of the garment, following closure of the toe ends, and j. means to return the clamps while open to a position in advance of the toe closing means.

19. In a machine for closing the toe ends of a bifurcated garment having waist, pant, leg and toe fabric portions, a. toe closing means for closing the toe ends by seams composed of a continuous chain of stitches, b. a pair of spaced clamps normally disposed in advance of the toe closing means, each of said clamps being pivotal about a vertical axis, c. means to close the clamps to clamp separately the ends of the toe portions of the garment preparatory to closure thereof, d. means to advance successively the clamps and their clamped toe portions relative to the toe closing means to form substantially identical toe closures in each toe end of the garment, e. cam followers connected to each clamp, and operable to cause the clamps to pivot about their vertical axes, f. a stationary cam track for guiding the cam followers, as the clamps advance relative to the toe closing means, g. a retractable cam operable to alter the form of the stationary cam track, and to engage the cam followers as the clamps advance relative to the toe closing means, to impart selected arcuate displacement to the clamps and their clamped toe fabrics, h. whereby substantially identical toe closures of selected curved configuration are formed in each toe end of the garment, i. means to open the clamps to unclamp the toe portions of the garment, following closure of the toe ends, and j. means to return the clamps while open to a position in advance of the toe closing means.

20. The machine of claim 19, further including:

a. stitch chain severing means automatically operative to sever the chain of stitches proximate the fabrics of the toe portions of the garment, and b. means for applying a gentle external force to the clamped toe portions to flatten the fabrics of the toe ends during closure thereof by the toe closing means.

* * * * *